US006796557B2

(12) United States Patent
Watanabe et al.

(10) Patent No.: US 6,796,557 B2
(45) Date of Patent: Sep. 28, 2004

(54) SHEET PROCESSING APPARATUS HAVING A PLURALITY OF CALCULATION SECTIONS

(75) Inventors: Hiroshi Watanabe, Chigasaki (JP); Toru Otsuka, Fujisawa (JP); Kunio Fukatsu, Yokohama (JP); Shigemi Kawamura, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 66 days.

(21) Appl. No.: 10/023,744

(22) Filed: Dec. 21, 2001

(65) Prior Publication Data

US 2002/0113366 A1 Aug. 22, 2002

(30) Foreign Application Priority Data

Dec. 26, 2000 (JP) ..... 2000-396016

(51) Int. Cl.[7] ..... B65H 43/08; B65H 29/22; B65H 29/34

(52) U.S. Cl. ..... 271/176; 271/3.15; 271/187; 271/315; 209/534

(58) Field of Search ..... 271/315, 187, 271/176, 3.15; 209/534

(56) References Cited

U.S. PATENT DOCUMENTS

| | | | | | |
|---|---|---|---|---|---|
| 3,512,771 | A | * | 5/1970 | Dempsey et al. | 271/176 |
| 4,088,314 | A | * | 5/1978 | Phillips | 271/176 |
| 4,244,565 | A | * | 1/1981 | Geier | 271/176 |
| 4,420,153 | A | * | 12/1983 | Winkler et al. | 271/304 |
| 4,638,993 | A | * | 1/1987 | Granzow et al. | 271/315 |
| 4,790,526 | A | * | 12/1988 | Egashira | 271/315 |
| 4,877,230 | A | * | 10/1989 | Winkler et al. | 271/3.15 |
| 4,971,303 | A | * | 11/1990 | Lange et al. | 270/60 |
| 5,135,115 | A | * | 8/1992 | Miller et al. | 209/564 |
| 5,541,393 | A | * | 7/1996 | Ikezawa et al. | 235/98 R |
| 5,641,156 | A | * | 6/1997 | Nukada et al. | 271/176 |
| 5,653,428 | A | * | 8/1997 | Dufour et al. | 270/6 |
| 5,732,944 | A | * | 3/1998 | Mayer | 271/265.01 |
| 5,996,314 | A | * | 12/1999 | Pennini et al. | 53/399 |
| 6,460,705 | B1 | * | 10/2002 | Hallowell | 209/534 |
| 6,494,447 | B2 | * | 12/2002 | Myer, Sr. | 271/176 |
| 6,623,001 | B2 | * | 9/2003 | Steinkogler et al. | 271/176 |
| 2002/0173874 | A1 | * | 11/2002 | Lax | 700/223 |
| 2003/0121838 | A1 | * | 7/2003 | Werner et al. | 209/534 |

FOREIGN PATENT DOCUMENTS

| | | | | |
|---|---|---|---|---|
| EP | 391550 | * | 10/1990 | B65H/43/00 |
| EP | 0 647 583 A2 | | 9/1994 | |
| EP | 1 167 259 A2 | | 1/2002 | |
| GB | 2168687 | * | 6/1986 | B65H/43/00 |
| JP | 59-153756 | | 9/1984 | |
| JP | 62-215459 | * | 9/1987 | 271/187 |
| JP | 63-51267 | * | 3/1988 | 271/187 |
| JP | 63-208445 | * | 8/1988 | 271/3.15 |
| JP | 2001-273538 | | 10/2001 | |

* cited by examiner

*Primary Examiner*—Donald P Walsh
*Assistant Examiner*—Daniel K Schlak
(74) *Attorney, Agent, or Firm*—Pillsbury Winthrop LLP

(57) ABSTRACT

There is disclosed a processing apparatus of sheets using an accumulation device of a vaned wheel system including a vaned wheel having a plurality of blades arranged at a predetermined interval in a rotation direction, and rotating, thereby allowing continuously feed sheets to enter between the blades, and guiding the sheets in a predetermined direction, so that the sheets guided by the vaned wheel are laminated/accumulated in an accumulation section, and synchronization is established between a supply timing of paper money by a paper money supply section and a rotation phase of the vaned wheel.

12 Claims, 12 Drawing Sheets

SHEET PROCESSING APPARATUS HAVING A PLURALITY OF CALCULATION SECTIONS

CROSS-REFERENCE TO RELATED APPLICATIONS

This application is based upon and claims the benefit of priority from the prior Japanese Patent Application No. 2000-396016, filed Dec. 26, 2000, the entire contents of which are incorporated herein by reference.

BACKGROUND OF THE INVENTION

1. Field of the Invention

The present invention relates to a processing apparatus of sheets, such as a classifying/sorting apparatus of sheets using accumulation means of a vaned wheel system, which classifies and sorts sheets such as paper money or checks, gift certificates, or other securities by type.

2. Description of the Related Art

Paper money or checks, gift certificates, other securities, or the like function as a key medium of social economic activities, and gather in large quantities in circulation. As a result a business for sorting these by a face value or type has developed. In order to automate this type of business or save energy, there has been provided an apparatus called a paper money classifying/sorting apparatus in which separate sheets of paper money are supplied, distinguished, and classified/accumulated by respective types (amounts of money), or formed in bundles each of 100 sheets.

This type of apparatus has a problem that the medium is flexible and it is therefore difficult to discharge a tip end of continuously fed paper money from a feeding path and accumulate the money in a laminate state. That is, the tip end of paper money collides against a rear end of another paper money or the tip end buckles by contact between paper money.

On the other hand, in a known accumulation apparatus of a vaned wheel system, a blade is rotated for about one or two blades with respect to about one sheet of continuously incoming paper money, and each sheet of paper money is introduced into a space formed in a gap among the blades. This is broadly utilized as a system in which collision between paper money does not occur or buckling does not occur by the contact of paper money.

That is, as shown in FIGS. 1, 2, paper money P horizontally held/fed by a pair of belts (not shown) is sorted by a gate device (not shown), and guided to a vaned wheel 101. Usually, the paper money P is accumulated in a horizontal state as shown in FIG. 1. Even in this vaned wheel system, there is a small probability that a tip end of the paper money P collides against a tip end 102*a* of a blade 102 of the vaned wheel 101 as shown in FIG. 2. In this case, a problem is that the paper money P has the tip end thereof bent as shown by J, jumps out of the vaned wheel 101, and indicates an unstable behavior such as a jam.

Moreover, when the aforementioned phenomenon occurs, the paper money P buckles in the blade 102 of the vaned wheel 101. Furthermore, when two sets of vaned wheels are used as is usual, the paper money disadvantageously enters blades having different phases in the two vaned wheels.

Once the phenomenon occurs even at a low frequency, this causes a serious problem in business. The paper money P is contaminated/damaged, and remains in an irregular position, and there is disagreement in a counted number of sheets of paper money.

A state of FIG. 1 may constantly be set in order to prevent the tip end of the blade of the vaned wheel from colliding against the tip end of the paper money. Even in the conventional accumulation apparatus of the vaned wheel system, there is an example in which a taking-out device of the paper money is mechanically synchronized with rotation of the vaned wheel by a timing belt or the like, and the tip end of the paper money is devised not to collide against the tip end of the blade.

However, this system has not only a problem that a mechanism for mechanical synchronization is expensive and complicated, but also a problem that it is impossible to handle a dispersion of a pitch between the paper money during actual taking-out and subsequent feeding.

That is, when the paper money is taken out, a taking-out pitch fluctuates by a subtle dispersion of friction force among the paper money. When the paper money is fed by a feeding belt, a pitch or a skew fluctuates by a change of feeding speed caused by a change of a belt property by temperature, or irregular contact with respect to a guide plate.

Moreover, for example, in Jpn. Pat. Appln. KOKAI Publication No. 59-153756, there is disclosed a technique in which a number of rotations of the vaned wheel is set to be variable, a passing timing of the paper money is measured in the feeding path in the vicinity of the vaned wheel, a feeding deviation per sheet of paper money is fed back, and the timing is synchronized with that of the vaned wheel.

However, in this system, the phase of the blade has to be controlled for each sheet with an immediately previous signal, and a high-speed response property is demanded. There is a problem that the system becomes expensive and control stability is poor. That is, there is a demand for an inexpensive system in which synchronization can be established between the vaned wheel and the incoming paper money by a simple control.

BRIEF SUMMARY OF THE INVENTION

An object of the present invention is to provide a processing apparatus of sheets in which a rotation phase of a vaned wheel can be controlled to have an optimum phase, so that a tip end of a sheet of paper does not easily collide against a tip end of a blade with use of accumulation means of a vaned wheel system.

According to the present invention, there is provided a processing apparatus of sheets, comprising:

supply section configured to supply the sheets;

feeding section configured to feed the sheets supplied by the supply section;

a vaned wheel which has a plurality of blades, and which rotates, thereby allowing the feed sheets to enter between the blades, and guides the sheets in a predetermined direction;

an accumulating section for accumulating the sheets guided by the vaned wheel;

at least two detection sections, disposed at a predetermined interval in a feeding direction in a middle portion of the feeding sections, for detecting the sheets fed by the feeding section;

measurement section configured to measure a passing time of the sheets fed by the feeding section in each detection section based on a detection result of each detection section;

calculation section configured to obtain a control amount of a rotation phase of the vaned wheel from a measurement result of the measurement section; and control section configured to control the rotation phase of the vaned wheel in accordance with the control amount obtained by the calculation section.

Moreover, according to the present invention, there is provided a processing apparatus of sheets, comprising:

supply section configured to supply the sheets sheet by sheet;

feeding section configured to feed the sheets supplied by the supply section;

detection section configured to detect a type of the sheets from the sheets fed by the feeding section;

sorting section configured to sort the sheets fed by the feeding section in accordance with a detection result of the detection section;

a vaned wheel which has a plurality of blades arranged at a predetermined interval in a rotation direction, and which rotates, thereby allowing the sheets sorted by the sorting section to enter between the blades, and guides the sheets in a predetermined direction;

an accumulation section for accumulating the sheets guided by the vaned wheel;

at least two detection sections, disposed at a predetermined interval in a middle portion of the feeding section, for detecting the sheets fed by the feeding section;

measurement section configured to measure a tip-end passing time of the sheets fed by the feeding section in each detection section based on a detection result of the detection section;

calculation section configured to obtain a control amount of a rotation phase of the vaned wheel from a measurement result of the measurement section; and control section configured to control the rotation phase of the vaned wheel in accordance with the control amount obtained by the calculation section.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

An embodiment of the present invention will be described hereinafter with reference to the drawings.

A first embodiment will first be described.

Figure 3:
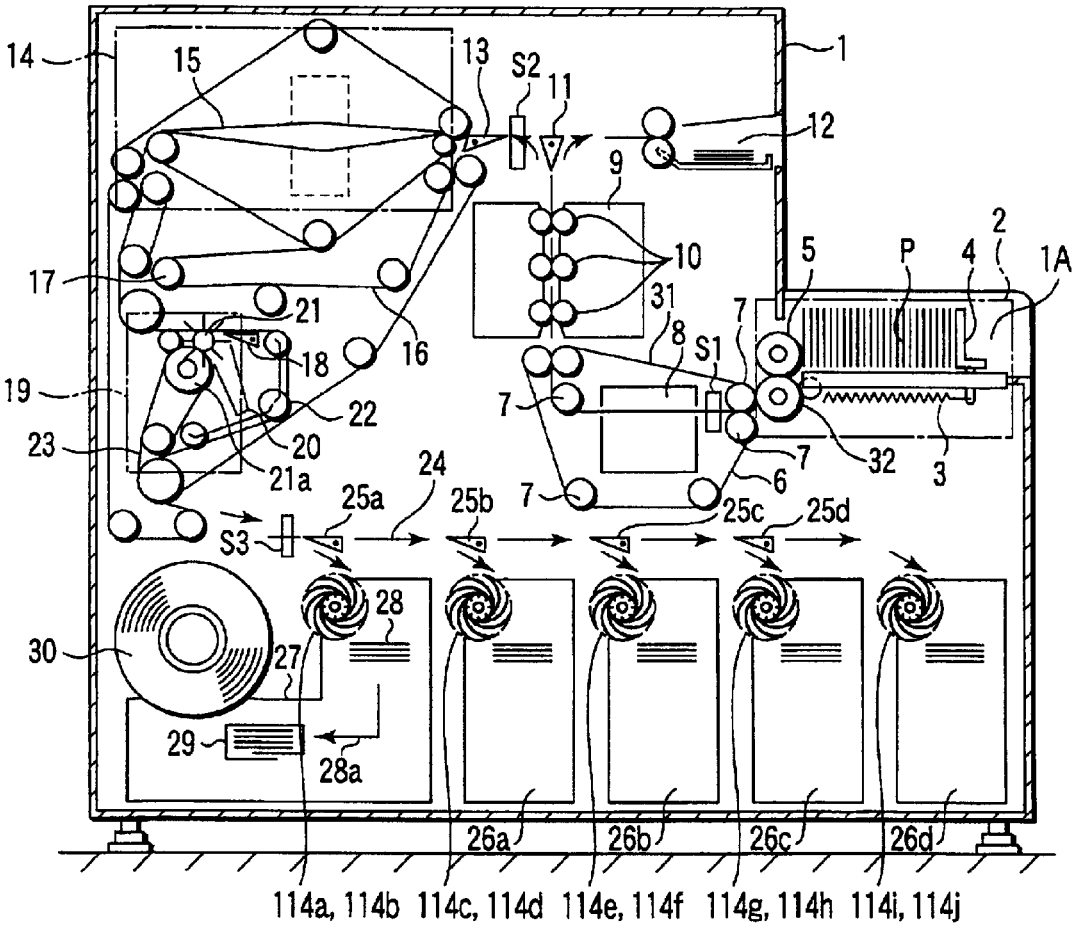
FIG. 3 is a side view schematically showing an internal constitution of a paper money classifying/sorting apparatus according to an embodiment of the present invention.

FIG. 3 schematically shows an internal constitution of a paper money classifying/sorting apparatus as a processing apparatus of sheets according to an embodiment of the present invention. In FIG. 3, a reference numeral 1 denotes a housing. A table section 1A is disposed in a middle portion on one side of the housing 1, and a paper money supply section 2 as supply means is disposed in the table section 1A. A plurality of sheets of paper money P as sheets are contained in an erected state in the paper money supply section 2. The paper money P is pressed onto delivery rollers 5 by a backup plate 4 which is urged by a spring 3.

The paper money P set in the paper money supply section 2 is taken out separately sheet by sheet by rotation of the delivery rollers 5, and held/fed by a clamp type feeding path 31 constituted of a belt 6 and rollers 7 as feeding means. An attitude correction device 8 for automatically correcting shift and skew of the taken-out paper money P is disposed in the feeding path 31. Since the attitude correction device 8 is not directly related with the scope of the present invention, the description thereof is omitted, but details are described, for example, in Jpn. Pat. Appln. No. 2000-82593.

A discrimination section 9 as detection means is disposed on a downstream side in a paper money feeding direction of the feeding path 31. The discrimination section 9 optically and magnetically reads each type of information from a surface of the paper money P fed by a pair of rollers 10 as feeding means, logically processes the information, compares the information with reference information, and distinguishes dirt, presence/absence of breakage, money amount (type), four directions of top/bottom and front/back, and the like. When a pattern on the paper money P is correctly erected or vertically disposed, the top/bottom is judged to be correct. When the pattern on the paper money P is vertically reversed by 180 degrees, the top/bottom is judged to be reversed.

A first branch device 11 as switching means is disposed on the downstream side of the paper money feeding direction of the discrimination section 9. The first branch device 11 guides paper money which is not judged to be regular, such as double taken paper money, and paper money having a skew larger than a defined skew into a reject box 12 by distinction by the discrimination section 9. Alternatively, the device guides paper money which is judged to be regular in a second branch device 13 as switching means.

The second branch device 13 divides the feeding direction of the paper money P into first and second directions. A left/right reverse path 14 is disposed in the first direction, and a twist belt 15 for reversing left/right of the paper money P by 180 degrees is disposed in the left/right reverse path 14. A simple belt feeding section 16 is disposed in the second direction, and the paper money P is held or fed as it is. The paper money P branched and fed in the first and second directions joins one another in a junction section 17. Two path lengths extending to the junction section 17 are set to be equal to each other, and an interval of joined paper money does not deviate.

A third branch device 18 as switching means is disposed on the downstream side of the paper money feeding direction of the junction section 17. The third branch device 18 branches the feeding direction of the paper money P into third and fourth directions. A switch-back path section 19 is disposed in the third direction. A reverse box 20 into which the paper money P is introduced, and a beating wheel 21 for pressing a rear end of the paper money P guided into the reverse box 20 against a reverse roller 21*a* are disposed in the switch-back path section 19. When the paper money P is fed out of the reverse box 20, the paper money has the top/bottom thereof reversed and is fed.

A simple belt feeding section 22 is disposed in the fourth direction, and the paper money P is fed while maintaining an attitude thereof as it is. The paper money P branched and fed in the third and fourth directions joins one another in a junction section 23. Lengths of branch paths extending to the junction section 23 are set to be equal, and the interval after joining does not deviate.

A horizontal feeding path 24 as feeding means is disposed on the downstream side of the paper money feeding direction of the junction section 23. Branch devices 25*a* to 25*d* as sorting means whose number is less than a number of portions to be sorted by one are disposed in the horizontal feeding path 24. First to fourth classified pocket sections 26*a* to 26*d* are disposed as accumulation sections under the branch devices 25*b* to 25*d*. The paper money P is stacked and accumulated in a horizontal state in these classified pocket sections 26*a* to 26*d*.

A 100-sheets bundling device 27 is disposed under the branch device 25*a*. The 100-sheets bundling device 27 is constituted of: an accumulation section 28 for accumulating and sorting every 100 sheets of paper money P; a feeding section 28*a* for feeding the paper money P from the accumulation section 28; and a banding section 29 for binding the paper money P fed by the feeding section 28*a* with a paper band 30.

An optical sensor S1 as detection means for detecting the paper money P passed toward the attitude correction device 8 through the feeding path 31 is disposed in a feeding end of the feeding path 31 immediately after the delivery rollers 5. Moreover, an optical sensor S2 as detection means for detecting the paper money P passed toward the second branch device 13 through the sensor is disposed between the first branch device 11 and the second branch device 13. Furthermore, an optical sensor S3 as detection means for detecting the paper money P passed toward the accumulation section through the feeding path 24 is disposed before the branch device 25*a* (accumulation section).

Figure 4:
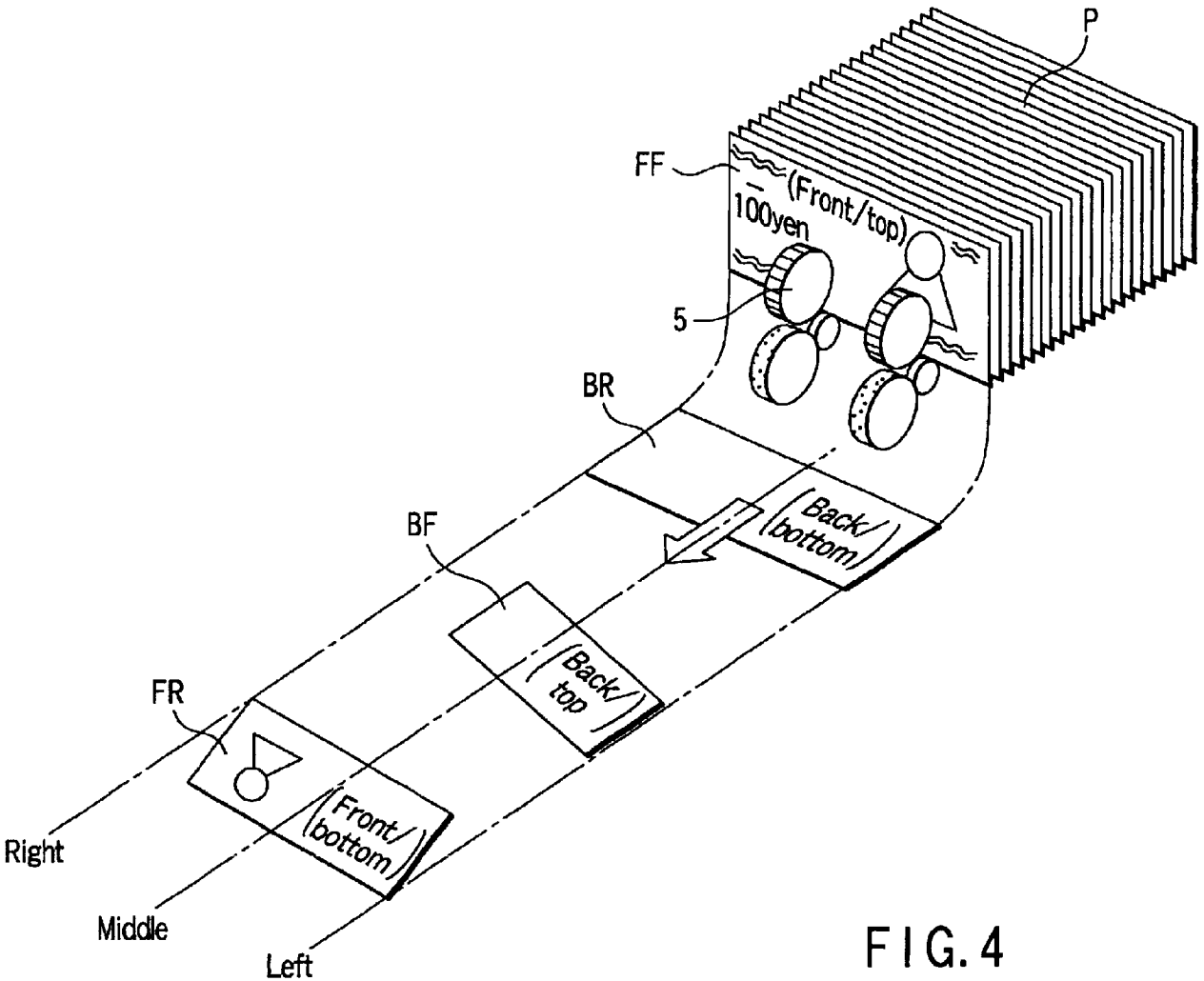
FIG. 4 is an explanatory view of an attitude of paper money supplied from a paper money supply section.

FIG. 4 shows the attitude of the paper money P supplied from the paper money supply section 2. That is, the paper money P, a note, and the like differ in size with a face value. Therefore, when these are collectively set in the paper money supply section 2, and even when they are manually aligned, small-sized paper money is buried in a maximum size, and there is a high possibility of a left/right position deviation and skewing.

That is, middle-sized paper money FR having a front facing upwards and a reversed top/bottom (hereinafter referred to as an FR note) has little left/right position deviation, but is skewed to the right. Paper money BF following the FR note and having a back facing upwards and a normal top/bottom direction (hereinafter referred to as a BF note) deviates on a left side, and is skewed to the left. Moreover, paper money BR following the BF note and having the back facing upwards and a reversed top/bottom direction (hereinafter referred to as a BR note) is not skewed and does not deviate. Additionally, paper money supplied following the BR note and having the front facing upwards and the normal top/bottom direction is regular and called an FF note.

Respective vaned wheels as main constituting elements of the present invention are disposed in upper portions of the classified pocket sections 26*a* to 26*d* and accumulation section 28, and are constituted, for example, as shown in FIGS. 5 to 8.

For example, constitutions of vaned wheels 114*a*, 114*b*, and the like disposed in the upper portion of the accumulation section 28 will be described.

That is, three feeding belts 110*a*, 110*b*, 110*c* as feeding means are disposed in parallel to a feeding surface in the upper portion of the accumulation section 28. Each belt is constituted of a pair of belts 111, 112, and rotated by a roller 113, and the paper money P is held/fed by a holding force of the pair of belts 111, 112.

The vaned wheels 114*a*, 114*b* for accepting and guiding the fed paper money P in a predetermined direction are coaxially disposed between the respective feeding belts 110*a*, 110*b*, 110*c*. Each of the vaned wheels 114*a*, 114*b* is constituted by attaching a plurality of blades 116, . . . in equally divided positions of a circumference of a cylindrical member 115, and the paper money P is guided into a space formed by two adjoining blades 116, 116. The paper money P guided by the vaned wheels 114*a*, 114*b* is guided into the accumulation section 28 positioned in the vicinity of a position under the vaned wheel, and laminated/accumulated.

The vaned wheels 114*a*, 114*b* are fixed to tip ends of rotation shafts 120*a*, 120*b*, respectively, and other ends of the rotation shafts 120*a*, 120*b* are connected to stepping motors 117*a*, 117*b*. Thereby, two sets of vaned wheels 114*a*, 114*b* are driven by the respective independent stepping motors 117*a*, 117*b* so that a rotation step number per unit time can change.

Moreover, rotation discs 118*a*, 118*b* each having a hole in one position in an outer peripheral portion of the disc are fixed to respective rotation shafts of the stepping motors 117*a*, 117*b*, and optical sensors 119*a*, 119*b* for detecting hole positions of the rotation discs 118*a*, 118*b* are disposed. When the optical sensors 119*a*, 119*b* detect the positions of the holes of the rotation discs 118*a*, 118*b*, each of the vaned wheels 114*a*, 114*b* outputs a signal of one pulse for each rotation. The signals are used as reference signals SG1*a*, SG1*b* of rotation of the vaned wheels 114*a*, 114*b*.

Moreover, with respect to the vaned wheels 114*a*, 114*b*, stepping motors 117*a*, 117*b*, and optical sensors 119*a*, 119*b* of the accumulation section 28, vaned wheels 114*c*, 114*d*, pocket stepping motors 117*c*, 117*d*, and optical sensors 119*c*, 119*d* correspond in the pocket section 26*a* corresponding to a given denomination or a state of sheets. Vaned wheels 114*e*, 114*f*, pocket stepping motors 117*e*, 117*f*, and optical sensors 119*e*, 119*f* correspond in the pocket section 26*b* corresponding to a given denomination or a state of sheets. Vaned wheels 114*g*, 114*h*, pocket stepping motors 117*g*, 117*h*, and optical sensors 119*g*, 119*h* correspond in the pocket section 26*c* corresponding to a given denomination or a state of sheets. Vaned wheels 114*i*, 114*j*, stepping motors 117*i*, 117*j*, and optical sensors 119*i*, 119*j* correspond in the pocket section 26*d* corresponding to a given denomination or a state of sheets.

Moreover, signals from the optical sensors 119*c*, 119*d* are used as reference signals SG1*c*, SG1*d* of rotation of the vaned wheels 114*c*, 114*d*. Signals from the optical sensors 119*e*, 119*f* are used as reference signals SG1*e*, SG1*f* of rotation of the vaned wheels 114*e*, 114*f*. Signals from the optical sensors 119*g*, 119*h* are used as reference signals SG1*g*, SG1*h* of rotation of the vaned wheels 114*g*, 114*h*.

With respect to portions other than the aforementioned portions, the same reference numeral is attached and description is omitted.

The paper money P guided by the vaned wheels 114*c*, 114*d* is guided to the classified pocket section 26*a* positioned in the vicinity of a position under the vaned wheel, and laminated/accumulated. The paper money P guided by the vaned wheels 114*e*, 114*f* is guided to the classified pocket section 26*b* positioned in the vicinity of the position under the vaned wheel, and laminated/accumulated. The paper money P guided by the vaned wheels 114*g*, 114*h* is guided to the classified pocket section 26*c* positioned in the vicinity of the position under the vaned wheel, and laminated/accumulated. The paper money P guided by the vaned wheels 114*i*, 114*j* is guided to the classified pocket section 26*d* positioned in the vicinity of the position under the vaned wheel, and laminated/accumulated.

FIGS. 9 to 12 show feeding paths a to d of the paper money P. When the branch devices 11, 13, 18 are driven/controlled in accordance with a distinction result of the discrimination section 9, the feeding paths a to d are selectively set.

Figure 9:
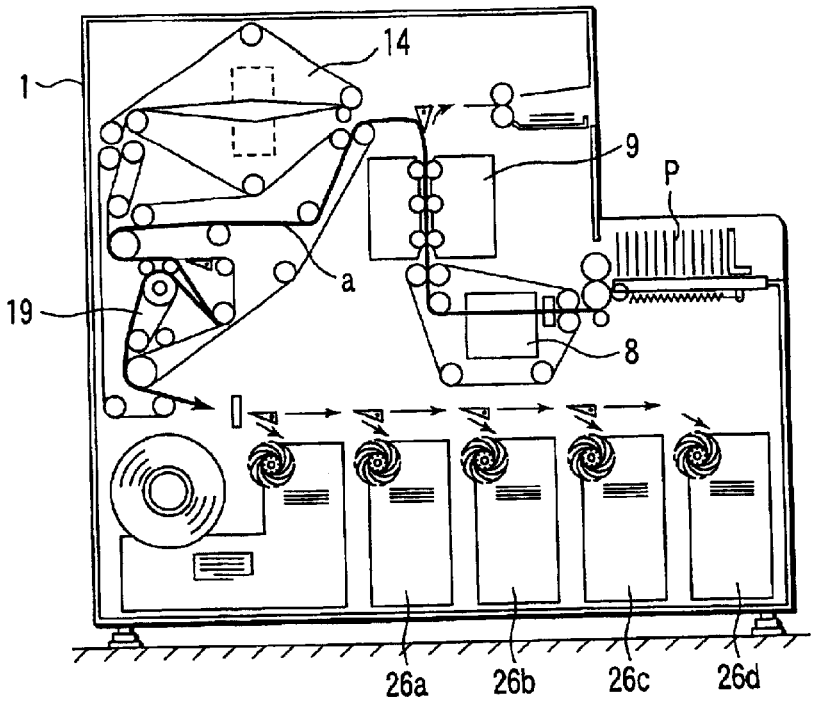
FIG. 9 is an explanatory view of a first feeding path of the paper money.
Figure 10:
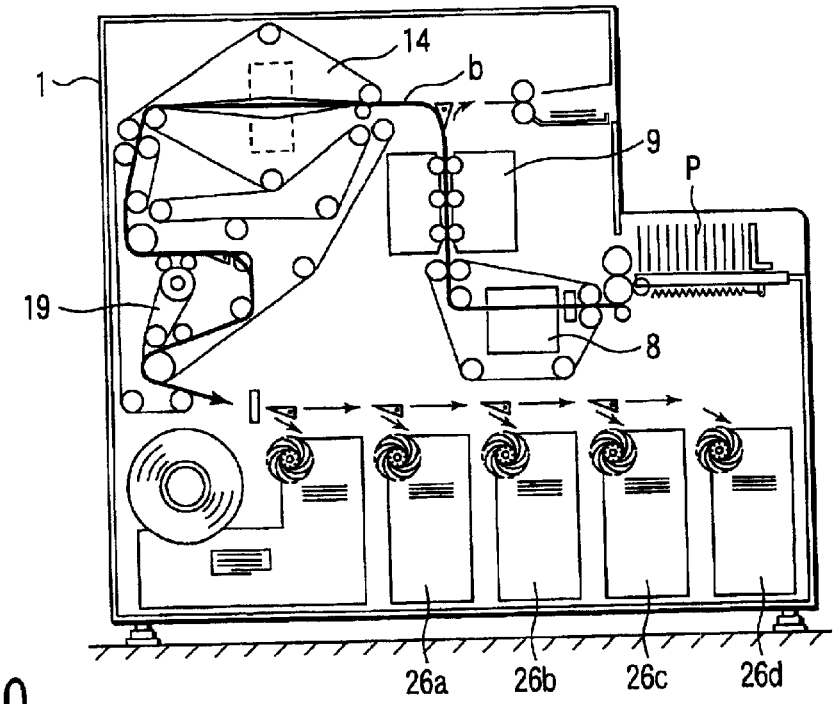
FIG. 10 is an explanatory view of a second feeding path of the paper money.
Figure 11:
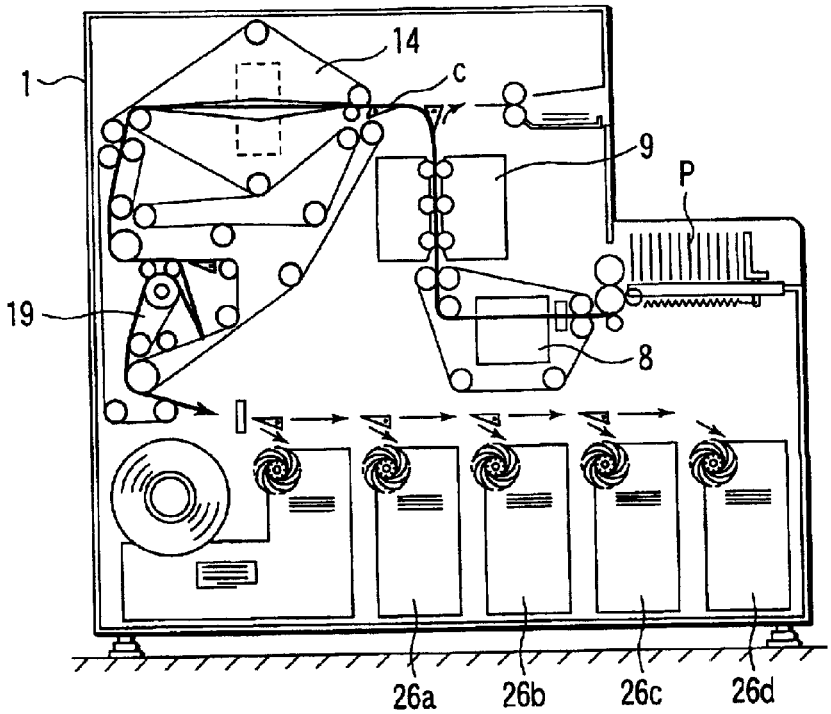
FIG. 11 is an explanatory view of a third feeding path of the paper money.
Figure 12:
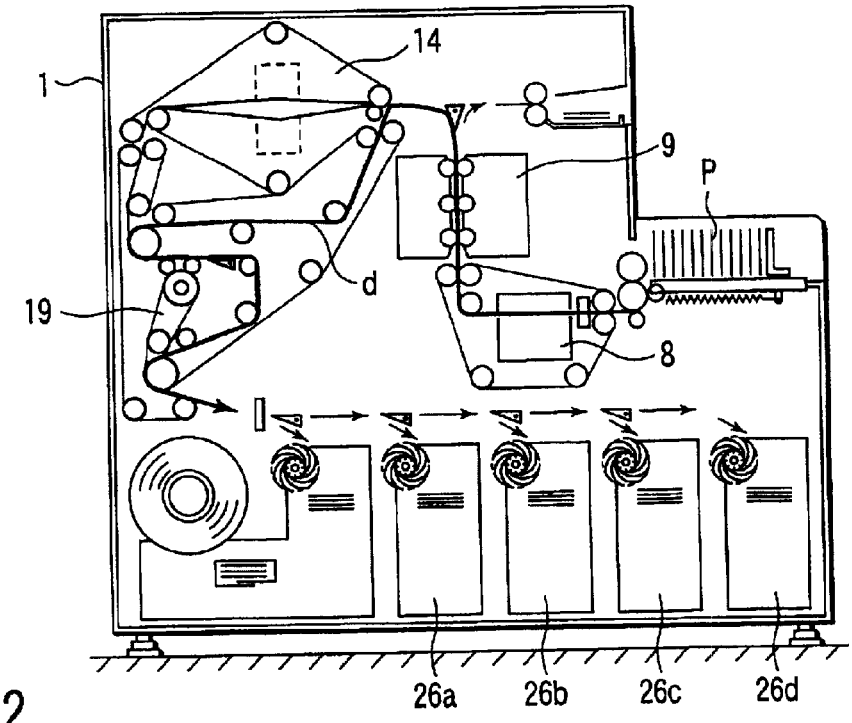
FIG. 12 is an explanatory view of a fourth feeding path of the paper money.

That is, when the discrimination section 9 distinguishes the paper money P as the FF note, the feeding path a shown in FIG. 9 is set. When the paper money P is distinguished as the FR note, the feeding path b shown in FIG. 10 is set. When the paper money P is distinguished as the BF note from the direction thereof, the feeding path c shown in FIG. 11 is set. When the paper money P is distinguished as the BR note, the feeding path d shown in FIG. 12 is set.

The paper money P passes through the switch-back path 19 in the feeding path a of FIG. 9. The paper money P passes through the left/right reverse path 14 in the feeding path b of FIG. 10. The paper money P passes through the left/right reverse path 14 and switch-back path 19 in the feeding path c of FIG. 11. The paper money P does not pass through the left/right reverse path 14 switch-back path 19 in the feeding path d of FIG. 12.

Since the paper money P is fed in any one of the feeding paths a to d, the paper money having the front/back and top/bottom all aligned enters the horizontal feeding path 24. Therefore, the paper money P classified by the type is laminated in the horizontal state in the classified pockets 26*a* to 26*d* while the front/back and top/bottom are all aligned. The paper money P can be wound with the paper band 30 even in the 100-sheets bundling device 27 while the front/back and top/bottom are aligned.

Figure 13A:
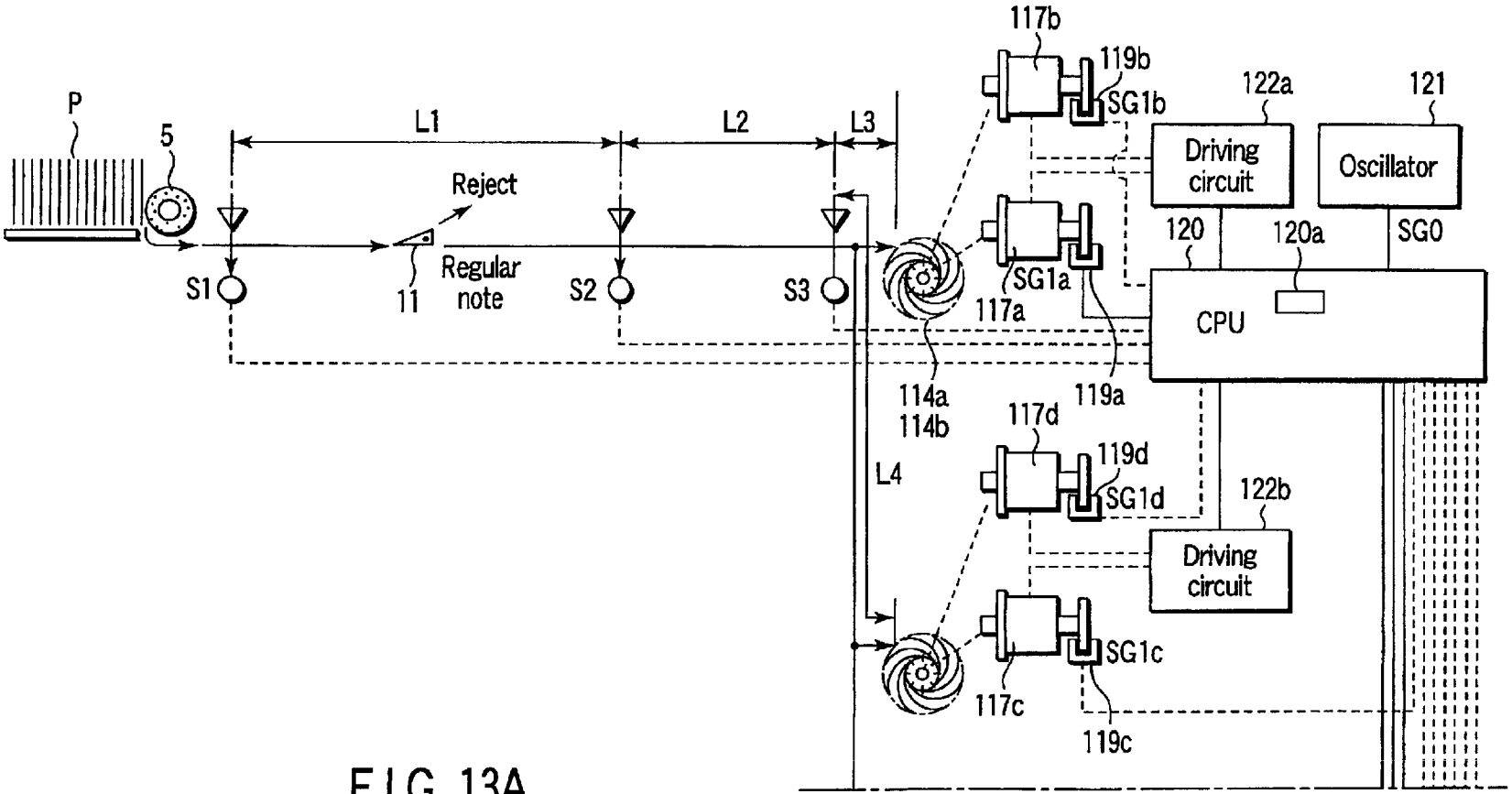
FIGS. 13A and 13B are a constitution diagram schematically showing a controller for mainly performing synchronous control of the vaned wheel and an associated portion.
Figure 13B:
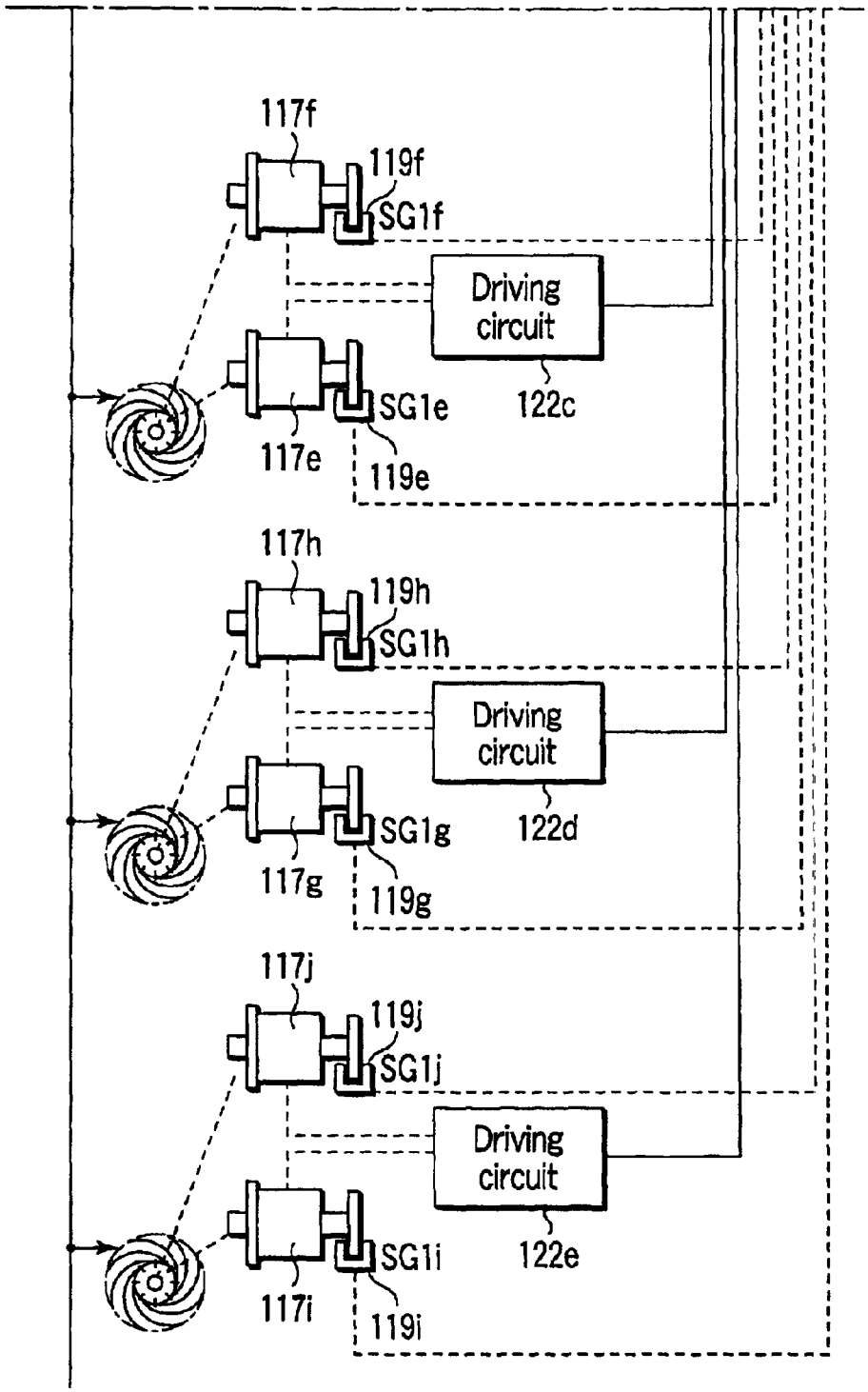

FIGS. 13A and 13B schematically shows a controller for performing synchronous control of the vaned wheels 114*a* to 114*j*. In FIG. 13, respective output signals of the sensors S1, S2, S3 are sent to a central processing unit (CPU) 120 as control means. The CPU 120 performs a whole operation control and various types of processing, and is connected to an oscillator 121. The oscillator 121 generates a reference signal (pulse) SG0 having a constant period as a reference of the control.

The CPU 120 is connected to driving circuits 122*a* to 122*e*. The stepping motors 117*a*, 117*b* are driven/controlled by the driving circuit 122*a*. The stepping motors 117*c*, 117*d* are driven and controlled by the driving circuit 122*b*. The stepping motors 117*e*, 117*f* are driven/controlled by the driving circuit 122*c*. The stepping motors 117*g*, 117*h* are driven and controlled by the driving circuit 122*d*. The stepping motors 117*i*, 117*j* are driven/controlled by the driving circuit 122*e*. Respective output signals SG1*a* to SG1*j* of the optical sensors 119*a* to 119*j* are sent to the CPU 120.

Figures 14A, 14B, 14C, 14D, 14E, 14F, 14G:
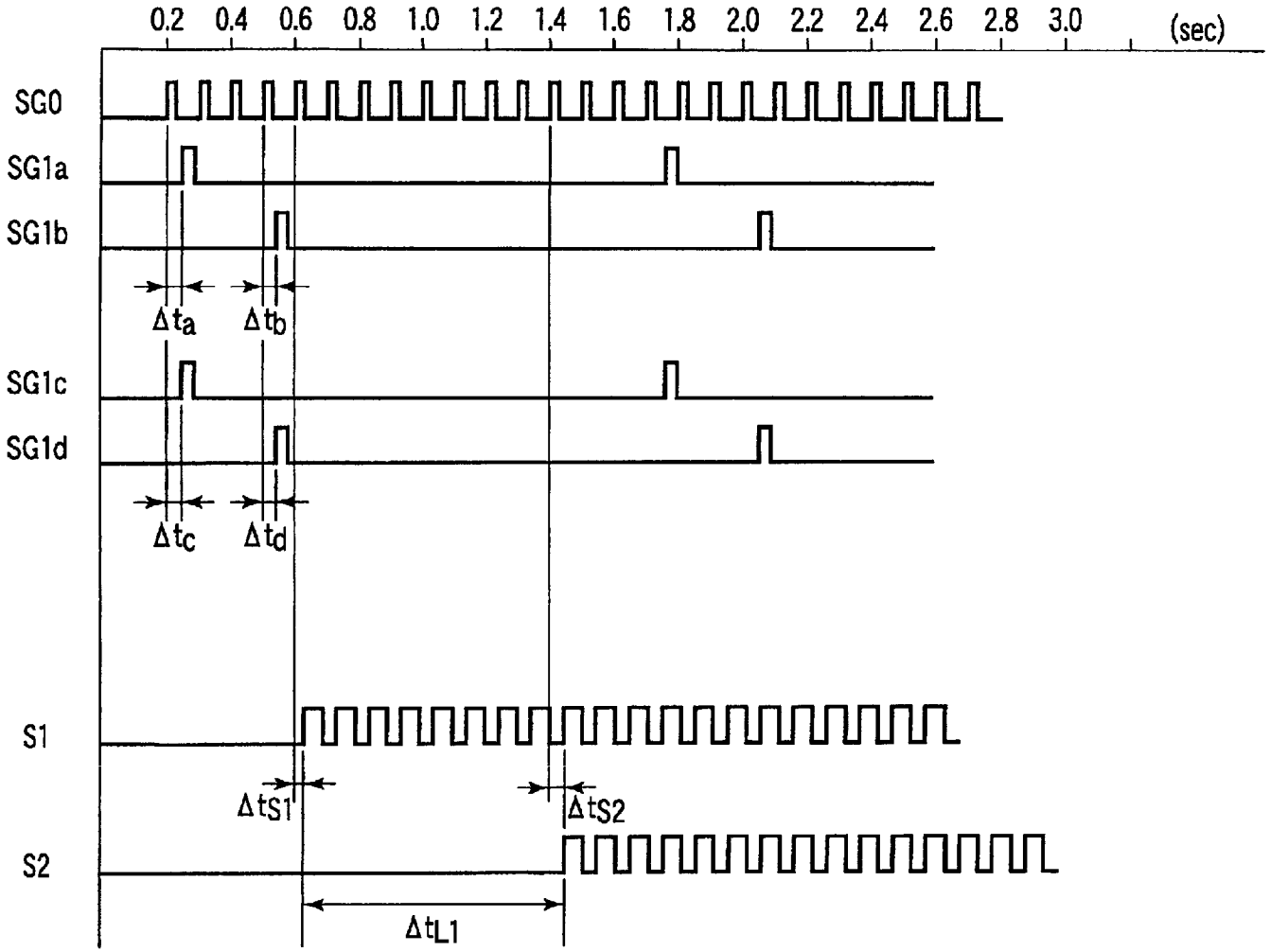
FIGS. 14A to 14G are timing charts showing synchronous control of the vaned wheel.
Figure 15:
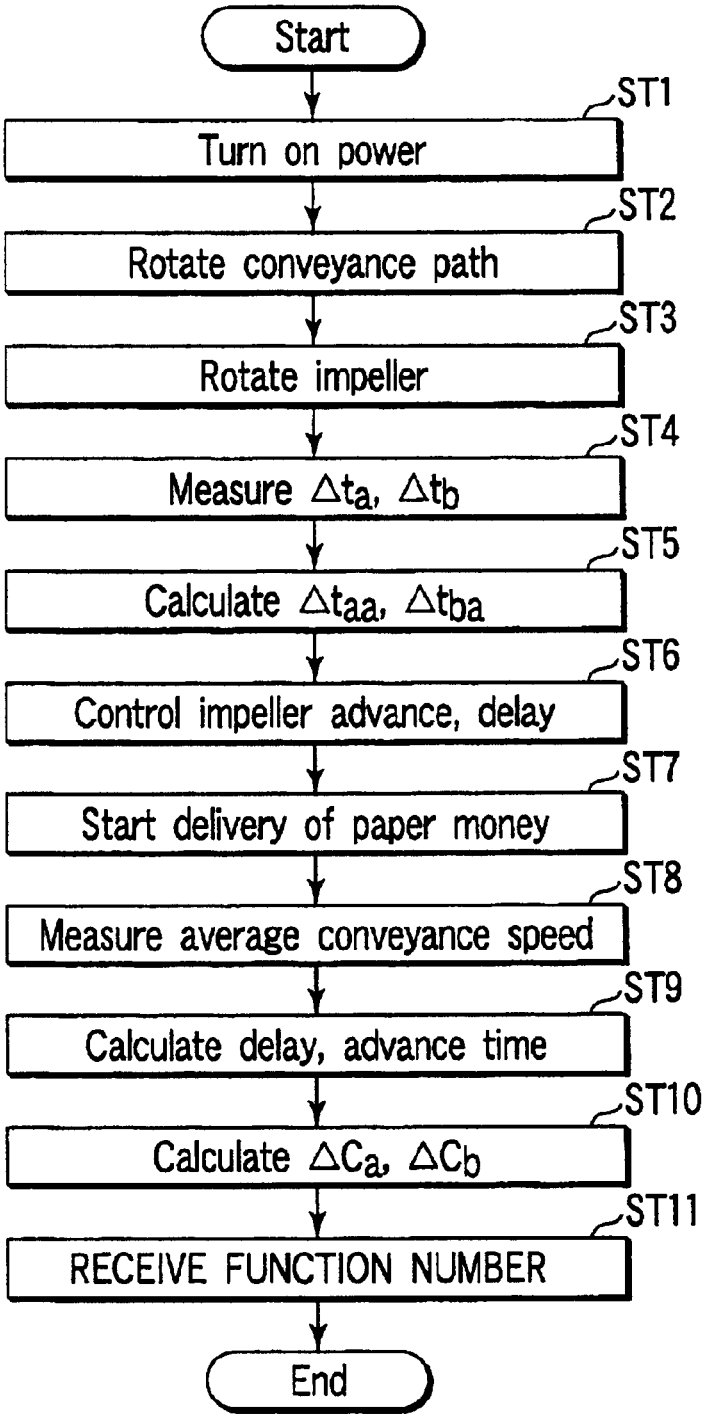
FIG. 15 is a flowchart showing the synchronous control of the vaned wheel.
Figure 16:
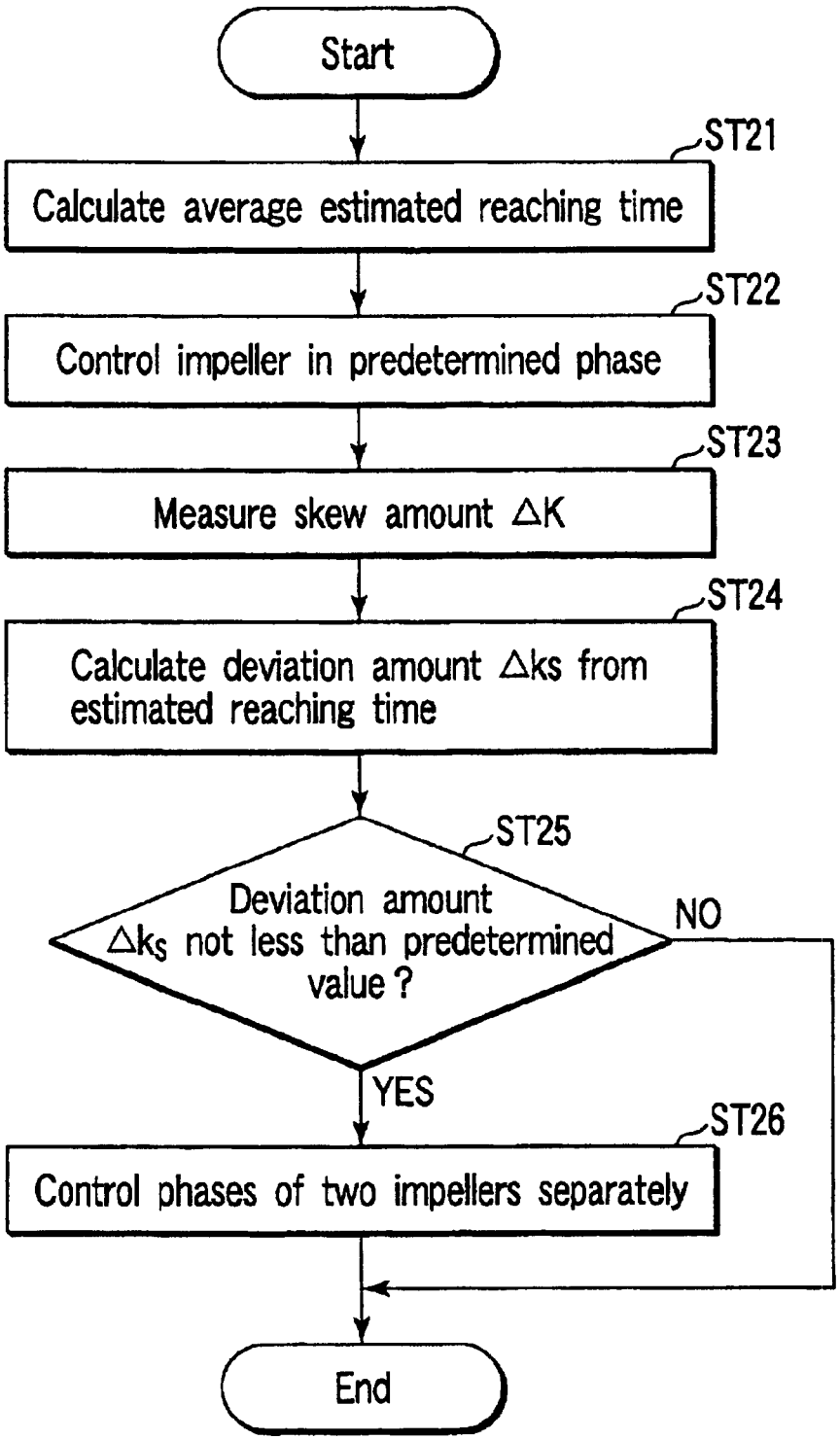
FIG. 16 is a flowchart showing a skew correction control of the vaned wheel.

The synchronous control of the vaned wheels 114*a*, 114*b*, 114*c*, 114*d* in the aforementioned constitution will next be described with reference to timing charts shown in FIGS. 14A to 14G, a flowchart shown in FIG. 15, and FIGS. 13A and 13B.

First, an initial setting of synchronization will be described.

In the present embodiment, it is assumed that a number of sheets n of the paper money P taken out by the delivery rollers 5 in the paper money supply section 2 is 20 sheets (n=20) per second. Moreover, the reference of the control is the reference signal (pulse) SG0 which is outputted by the oscillator 121 and which has a period of 1/n=50 ms as shown in FIG. 14A. That is, the reference signal SG0 corresponds to a supply timing of the paper money P supplied sheet by sheet from the paper money supply section 2.

When power is turned on (ST1), each feeding belt is rotated and driven at a reference speed of S0=2.0 m/second by an alternating-current motor (ST2).

Additionally, in the paper money supply section 2, the delivery roller 5 is controlled so that there is an equal distance from the tip end of the paper money P to the tip end of the next paper money P, and a pitch between the paper money is S0/n=100 mm.

When the apparatus starts supplying the paper money P, the CPU 120 generates a paper money delivery signal at a rising timing of the reference signal SG0 from the oscillator 121, and sends the signal to a driving circuit (not shown) of the delivery roller 5, and the paper money P is delivered. For a timing at which the delivered paper money P passes through the sensor S1, a deviation amount Δts1 from the reference signal SG0 indicates a constant value, and can be known beforehand, as long as the paper money P is correctly delivered.

Moreover, with a constant reference feeding speed, it is also possible to calculate a deviation amount Δts3 from the reference signal SG0 when the tip end of the paper money P passed through the sensor S1 with the deviation amount Δts1 reaches entrances of the vaned wheels 114*a*, 114*b*.

It is assumed that the sensor S1 for detecting the paper money P fed in the feeding path is disposed immediately after taking-out of the paper money P, the sensor S2 is disposed after the branch device 11 for distributing a regular note and a rejected note, and the sensor S3 is disposed immediately before the vaned wheels 114*a*, 114*b*. For respective distances, it is assumed that, for example, a distance between S1 and S2 is L1 (mm)=2400 mm, a distance between S2 and S3 is L2 (mm)=1300 mm, and a distance between S3 and the tip end of the vaned wheel is L3 (mm)=300 mm.

Then, a distance between the sensor S1 and the vaned wheels 114*a*, 114*b* is (L1+L2+L3)(mm)=4000 mm. In this case, when unit systems (mm) and (msec) are used, the following results.

$$X = ((L1 + L2 + L3)/S0 + \Delta ts1)/(1/n) \quad (1)$$

$$= ((4000/2)\text{ms} + \Delta ts1)/50\text{ ms}$$

Then, an integer remainder of a calculation result X of the above equation (1) is the deviation amount Δts3. The deviation amount Δts3 is a positive number, and is a delay time from the reference signal SG0 when the tip end of the paper money P reaches the vaned wheels 114*a*, 114*b*.

On the other hand, it is assumed that the output signals of the optical sensors 119*a*, 119*b* each outputting the signal once per rotation are SG1*a*, SG1*b* as shown in FIGS. 14B, 14C. Additionally, these signals SG1*a*, SG1*b* are outputted where the blade comes to the position of FIG. 1. That is, the tip end of the paper money P is substantially in a middle between the blades. For example, with 16 blades, the tip end is in a tenth position obtained by dividing a blade pitch of 22.5 degrees into nine pitches each of 2.5 degrees.

For a reference rotation number Fr of each of the vaned wheels 114*a*, 114*b*,, a rotation number of 16 reference signals SG0 per rotation is initially set as a rotation speed, assuming that one piece of paper money P enters with rotation of one blade (1/16 rotation) among 16 blades in one circumference. When the vaned wheels 114*a*, 114*b* are rotated in this manner (ST3), the respective stepping motors 117*a*, 117*b* are asynchronous, and therefore the signal SG1*a* or SG1*b* outputted for each rotation generates a timing deviation amount Δta or Δtb with respect to the reference signal SG0 as shown in FIGS. 14B, 14C. The amount is measured in the CPU 120 (ST4).

Figure 1:
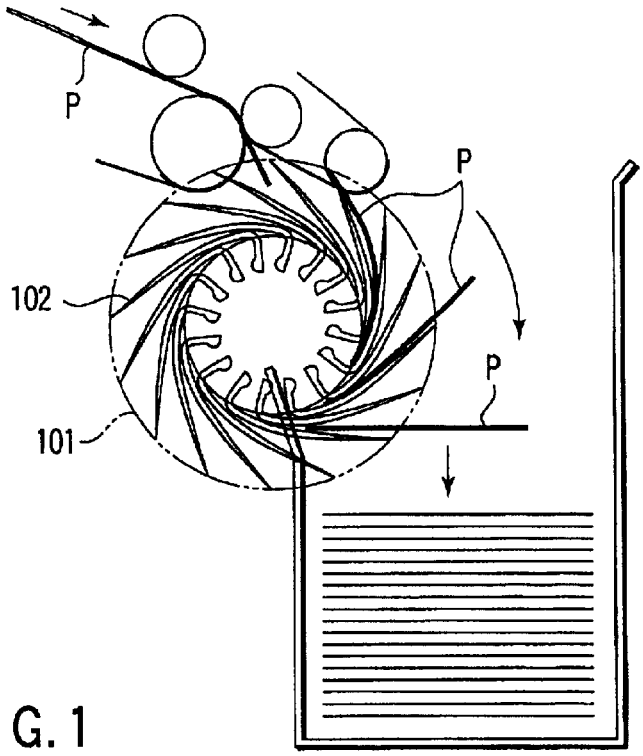
FIGS. 1 and 2 are explanatory views of a conventional accumulation apparatus of a vaned wheel system.

When the tip end of the fed paper money P reaches the tip end of the vaned wheel 114*a* or 114*b*, the blade of the vaned wheel 114*a* or 114*b* comes at a tenth time of FIG. 1. For this, the following results:

$$Ya=(\Delta ta-\Delta ts3)/(1/n) \quad (2);\text{ and}$$

$$Yb=(\Delta tb-\Delta ts3)/(1/n) \quad (3).$$

Integer remainders Δtaa, Δtba of calculation results Ya, Yb of the above equations (2) and (3) are obtained (ST5). When the value Δtaa or Δtba indicates a positive number, the vaned wheels 114*a*, 114*b* are delayed with respect to a reaching time of the paper money P. With a negative number, the vaned wheels 114*a*, 114*b* advance with respect to the reaching time of the paper money P. When the vaned wheels 114*a*, 114*b* advance, the vaned wheels are decelerated for a predetermined time. When the vaned wheels are delayed, the vaned wheels are accelerated for a predetermined time (ST6). Thereby, the reference feeding speed is assumed, and the vaned wheels 114*a*, 114*b* can be synchronized with an entering timing of the paper money P.

Moreover, it is also possible to calculate a deviation amount Δts3' from the reference signal SG0 when the tip end of the paper money P passed through the sensor S1 with the deviation amount Δts1 reaches the entrances of the vaned wheels 114*c*, 114*d*.

It is assumed that the sensor S1 for detecting the paper money P fed in the feeding path is disposed immediately after the taking-out of the paper money P, the sensor S2 is disposed behind the branch device 11 for distributing the regular note and rejected note, and the sensor S3 is disposed before the vaned wheels 114*c*, 114*d*. For the respective distances, it is assumed that, for example, the distance between S1 and S2 is L1 (mm), the distance between S2 and S3 is L2 (mm), and the distance between S3 and the tip end of the vaned wheel is (L4)(mm). Then, the distance between the sensor S1 and the vaned wheels 114*c*, 114*d* is (L1+L2+L4) (mm). In this case, when unit systems (mm) and (msec) are used, the following results.

$$X = ((L1 + L2 + L4)/S0 + \Delta ts1)/(1/n) \quad (1)$$

$$= ((4000/2)\text{ms} + \Delta ts1)/50\text{ ms}$$

Then, the integer remainder of the calculation result X of the above equation (1) is the deviation amount Δts3'. The deviation amount Δts3' is a positive number, and is a delay time from the reference signal SG0 when the tip end of the paper money P reaches the vaned wheels 114*c*, 114*d*.

On the other hand, it is assumed that the output signals of the optical sensors 119*c*, 119*d* each outputting the signal once per rotation of the vaned wheels 114*c*, 114*d* are SG1*c*, SG1*d* as shown in FIGS. 14D, 14E. Additionally, these signals SG1*c*, SG1*d* are outputted where the blade comes to the position of FIG. 2. That is, the tip end of the paper money P is substantially in the middle between the blades. For example, with 16 blades, the tip end is in the tenth position obtained by dividing the blade pitch of 22.5 degrees into nine pitches each of 2.5 degrees.

For the reference rotation number Fr of each of the vaned wheels 114*a*, 114*b*, the rotation number of 16 reference signals SG0 per rotation is initially set as a reference speed, assuming that one piece of paper money P enters with rotation of one blade (1/16 rotation) among 16 blades in one circumference. When the vaned wheels 114*c*, 114*d* are rotated in this manner (ST3), the respective stepping motors 117*c*, 117*d* are asynchronous, and therefore the signal SG1*c* or SG1*d* outputted for each rotation generates a timing deviation amount Δtc or Δtd with respect to the reference signal SG0 as shown in FIGS. 14D, 14C. The amount is measured in the CPU 120 (ST4).

Figure 2:
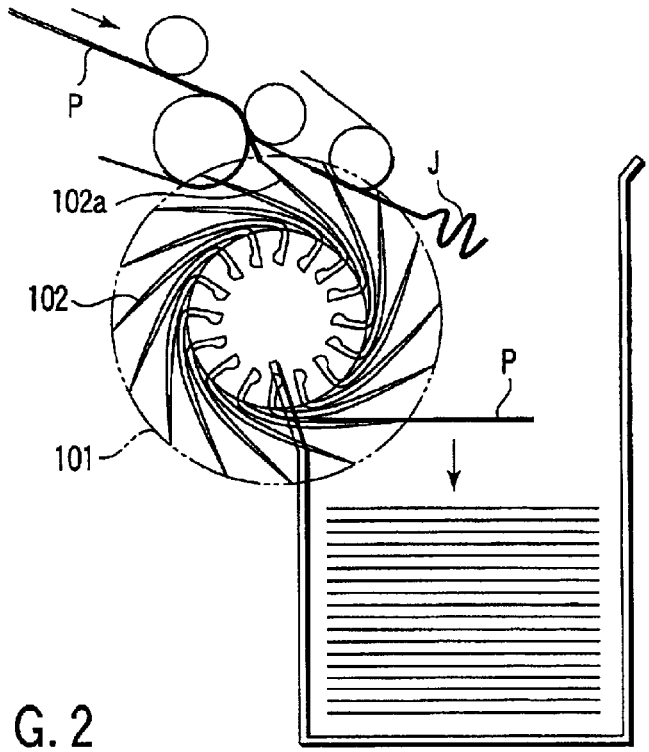

When the tip end of the fed paper money P reaches the tip end of the vaned wheel 114*c* or 114*d*, the blade of the vaned wheel 114*c* or 114*d* comes a tenth time of FIG. 2. For this, the following results:

$$Yc=(\Delta tc-\Delta ts3')/(1/n) \quad (2);\text{ and}$$

$$Yd=(\Delta td-\Delta ts3)/(1/n) \quad (3).$$

Integer remainders Δtca, Δtda of calculation results Yc, Yd of the above equations (2) and (3) are obtained (ST5). When the value Δtca or Δtda indicates a positive number, the vaned wheels 114*a*, 114*b* are delayed with respect to the reaching time of the paper money P. With the negative number, the vaned wheels 114*c*, 114*d* advance with respect to the reaching time of the paper money P. When the vaned wheels 114*c*, 114*d* advance, the vaned wheels are decelerated for a predetermined time. When the vaned wheels are delayed, the vaned wheels are accelerated for a predetermined time (ST6). Thereby, the reference feeding speed is assumed, and the vaned wheels 114*c*, 114*d* can be synchronized with the entering timing of the paper money P.

Moreover, similarly as described above, it is possible to establish synchronization between the other vaned wheels 114*e*, . . . and the entering timing of the paper money P.

This operation is performed as an initial setting in a type in which the feeding path is usually rotated with the power turned on before issuance of a supply start command of the paper money P.

Synchronization setting corresponding to a fluctuation of the feeding speed will next be described.

First, when the CPU 120 starts supplying the paper money P (ST7), the sensors S1 and S2 disposed in the feeding path detect the passing of the paper money P, and each detection signal is sent to the CPU 120. As shown in FIGS. 14F, 14G, the CPU 120 calculates a passing time ΔtL1 for which each paper money P is fed to the sensor S2 from S1 is calculated based on the respective detection signals of the sensors S1, S2. This time is obtained for a plurality of continuous sheets (e.g., 20 sheets), an average value is calculated, a feeding distance L1 is divided by the average value, and an average speed Svv (=L1/ΔtL1) is obtained (ST8).

A time ΔT in which the paper money P arrives at the tip end of the vaned wheels 114*a*, 114*b* from the sensor S1 is obtained from the average speed Svv as follows.

$$\Delta T=(L1+L2+L3)/Svv \tag{4}$$

On the other hand, a time ΔT0 in which the paper money is to arrive is obtained from a reference feeding speed S0 as follows.

$$\Delta T0=(L1+L2+L3)/\mathrm{S0} \tag{5}$$

$$\Delta T0-\Delta T=((L1+L2+L3)/\mathrm{S0})-((L1+L2+L3)/Svv)=\Delta f \tag{6}$$

Here, Δf is an error (time difference) generated by a difference from the reference speed as a result of fluctuation of an actual speed of the feeding path with a friction load, temperature change, and change with elapse of time. When the error indicates a plus value, occurrence of a delay is indicated. A minus value indicates occurrence of an advance (ST9).

Additionally, here, it is assumed that ΔA is a [remainder] of integer division of Δf/(1/n). In the aforementioned initial setting, since the vaned wheels 114*a*, 114*b* are synchronized with the reference signal SG0, a control amount ΔC of deviation with fluctuation of feeding speed of the paper money P is as follows (ST10).

$$Z=\Delta A/(1/n) \tag{7}$$

When a quotient of the equation (7) has a value of "0" or a positive value, a tip-end position of the paper money P is delayed with respect to the tip-end position of the vaned wheels 114*a*, 114*b*. A negative value indicates an advance. A driving pulse rate of the stepping motors 117*a*, 117*b* is changed so that the integer remainder (ΔC) of a calculation result Z is "0" (ST11). By the control, in the average value of the feeding pitch dispersion of the paper money P, the tip end of the paper money P contained in the accumulation section 28 can enter a middle position of the vaned wheels 114*a*, 114*b*.

Moreover, a time ΔT' in which the paper money P arrives at the tip end of the vaned wheels 114*c*, 114*d* from the sensor S1 is obtained from the average speed Svv as follows.

$$\Delta T'=(L1+L2+L4)/Svv \tag{4}$$

On the other hand, a time ΔT0' in which the paper money is to arrive is obtained from the reference feeding speed S0 as follows.

$$\Delta T0'(L1+L2+L4)/\mathrm{S0} \tag{5}$$

$$\Delta T0'-\Delta T'=((L1+L2+L4)/\mathrm{S0})--((L1+L2+L4)/Svv)=\Delta f' \tag{6}$$

Here, Δf' is an error (time difference) generated by the difference from the reference speed as the result of fluctuation of the actual speed of the feeding path with the friction load, temperature change, and change with elapse of time. When the error indicates the plus value, occurrence of delay is indicated. The minus value indicates occurrence of advance (ST9).

Additionally, here, it is assumed that ΔA' is a [remainder] of integer division of Δf'/(1/n). In the aforementioned initial setting, since the vaned wheels 114*c*, 114*d* are synchronized with the reference signal SG0, a control amount ΔC' of deviation with the fluctuation of feeding speed of the paper money P is as follows (ST10).

$$Z=\Delta A'/(1/n) \tag{7}$$

When the quotient of the equation (7) has the value of "0" or the positive value, the tip-end position of the paper money P is delayed with respect to the tip-end position of the vaned wheels 114*c*, 114*d*. The negative value indicates the advance. The driving pulse rate of the stepping motors 117*c*, 117*d* is changed so that the integer remainder (ΔC') of the calculation result Z is "0" (ST11). By the control, in the average value of the feeding pitch dispersion of the paper money P, the tip end of the paper money P contained in the classified pocket 26*a* can enter the middle position of the vaned wheels 114*c*, 114*d*.

Moreover, similarly as described above, in the average value of the feeding pitch dispersion of the paper money P, the tip end of the paper money P contained in each of the classified pockets 26*b*, 26*c*, 26*d* can enter the corresponding middle position of each of the vaned wheels 114*e*, 114*f*, 114*g*, 114*h*, 114*i*, 114*j*.

A second embodiment will next be described with reference to a flowchart shown in FIG. 15.

According to the aforementioned first embodiment, collision of the tip end of the paper money P against the blades of the vaned wheels 114*a*, 114*b* (114*c* to 114*j*) can considerably be prevented.

Figure 5:
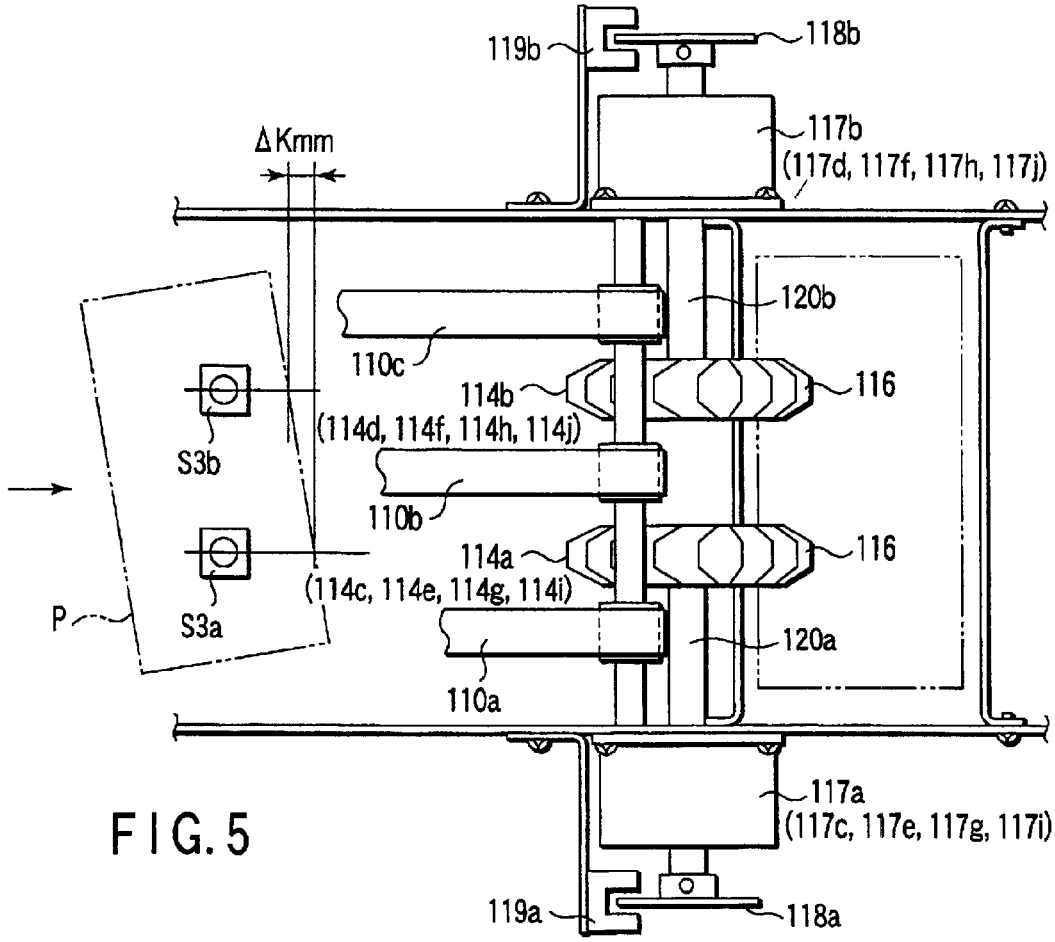
FIG. 5 is a plan view showing a constitution of a vaned wheel and a periphery thereof.
Figure 6:
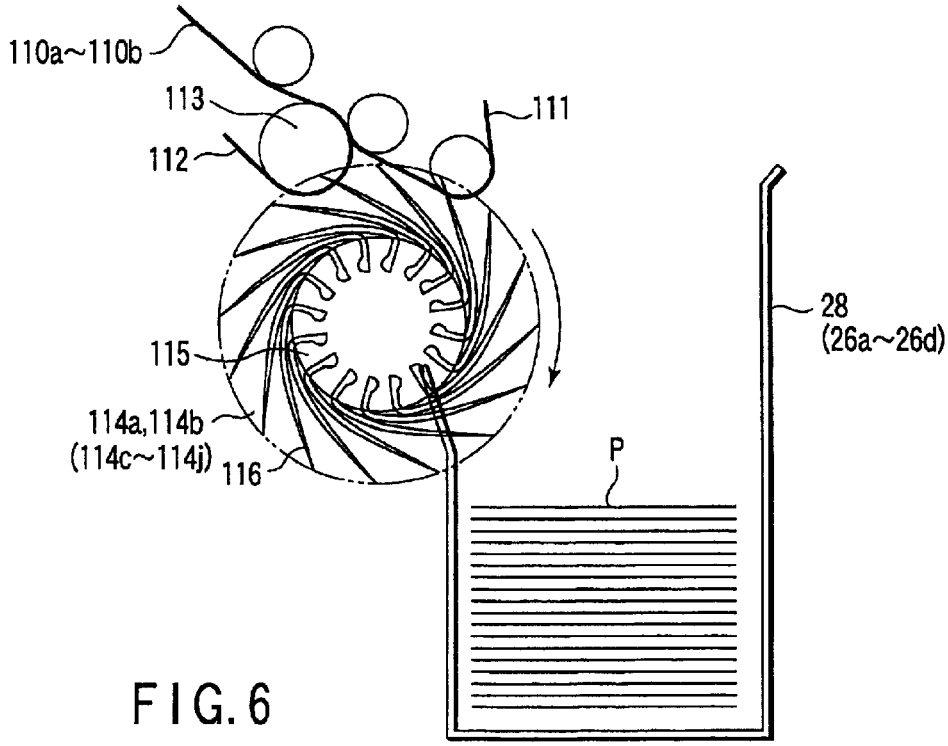
FIG. 6 is a side view showing a constitution of the vaned wheel.
Figure 7:
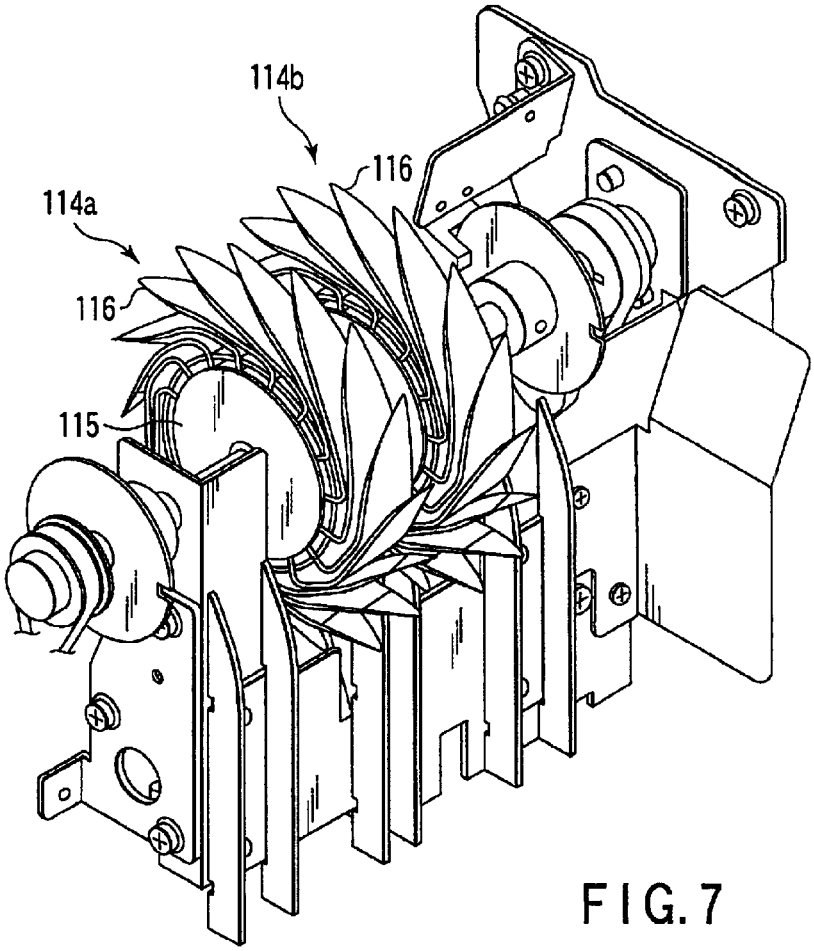
FIG. 7 is a perspective view showing a constitution of the vaned wheel and the periphery thereof.
Figure 8:
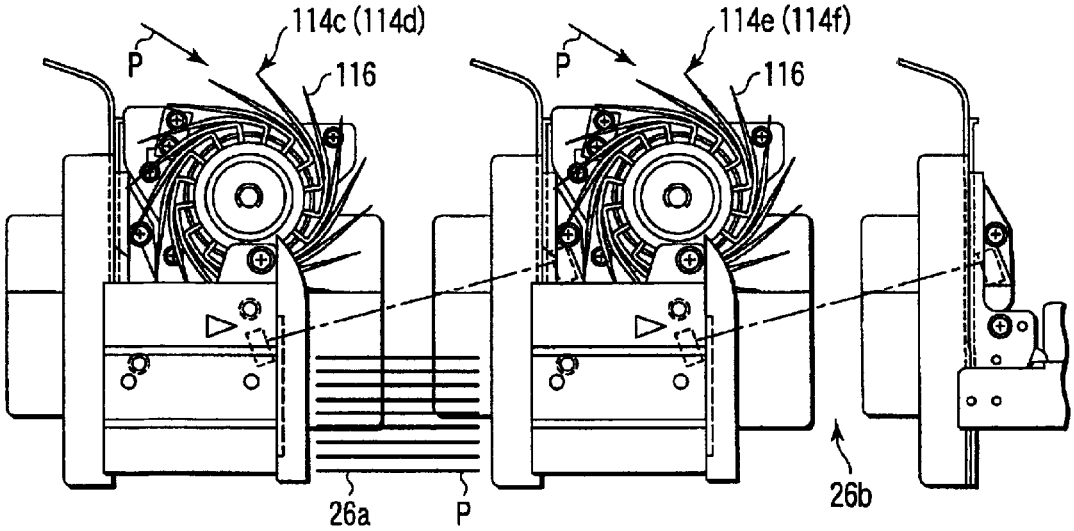
FIG. 8 is a side view showing a constitution of the vaned wheel and the periphery thereof.

However, when the paper money P is skewed and fed as shown in FIG. 5, the left and right vaned wheels 114*a*, 114*b* (114*c* and 114*d*, 114*e* and 114*f*, 114*g* and 114*h*, or 114*i* and 114*j*) rotate in the same phase. Therefore, a possibility of collision of the tip end of the paper money P against the vaned wheel on any side arises. On the other hand, it is assumed that the sensor S3 is divided into two sensors S3*a*, S3*b*, and these sensors are arranged in a direction crossing at right angles to the feeding direction of the paper money P. Then, a skew amount ΔK of the paper money P can be measured.

That is, in the second embodiment, similarly as the first embodiment, an average estimated reaching time is calculated from a feeding state of several tens of sheets after start of taking-out (ST21). That is, the CPU 120 calculates a time in which the paper money P reaches the tip end of the vaned wheels 114*a*, 114*b* from the sensor S1, a time in which the paper money P reaches the tip end of the vaned wheels 114*c*, 114*d* from the sensor S1, a time in which the paper money P reaches the tip end of the vaned wheels 114*e*, 114*f* from the sensor S1, a time in which the paper money P reaches the tip end of the vaned wheels 114*g*, 114*h* from the sensor S1, and a time in which the paper money P reaches the tip end of the vaned wheels 114*i*, 114*j* from the sensor S1.

Following this calculation, the CPU 120 controls the vaned wheels 114*a* to 114*j* in a predetermined phase (ST22). (corresponding to the steps 1 to 11 of the first embodiment)

In a controlled state, the CPU 120 measures the skew amount ΔK (ST23), and calculates a deviation amount Δks from an initial estimated reaching time (ST24), every time the paper money P stored in the accumulation section 28 passes through the sensors S3*a*, S3*b*. Only when the deviation amount Δks is larger than a predetermined amount (ST25), phases of the vaned wheels 114*a*, 114*b* are separately controlled (ST26).

Moreover, the CPU 120 measures the skew amount ΔK (ST23), and calculates the deviation amount Δks from the initial estimated reaching time (ST24), every time the paper money P stored in the classified pocket section 26*a* passes through the sensors S3*a*, S3*b*. Only when the deviation amount Δks is larger than the predetermined amount (ST25), the phases of the vaned wheels 114*c*, 114*d* are separately controlled (ST26).

Furthermore, the CPU 120 measures the skew amount ΔK (ST23), and calculates the deviation amount Δks from the initial estimated reaching time (ST24), every time the paper money P stored in the classified pocket section 26*b* passes through the sensors S3*a*, S3*b*. Only when the deviation amount Δks is larger than the predetermined amount (ST25), the phases of the vaned wheels 114*e*, 114*f* are separately controlled (ST26).

Additionally, the CPU 120 measures the skew amount ΔK (ST23), and calculates the deviation amount Δks from the initial estimated reaching time (ST24), every time the paper money P stored in the classified pocket section 26*c* passes through the sensors S3*a*, S3*b*. Only when the deviation amount Δks is larger than the predetermined amount (ST25), the phases of the vaned wheels 114*g*, 114*h* are separately controlled (ST26).

Moreover, the CPU 120 measures the skew amount ΔK (ST23), and calculates the deviation amount Δks from the initial estimated reaching time (ST24), every time the paper money P stored in the classified pocket section 26*d* passes through the sensors S3*a*, S3*b*. Only when the deviation amount Δks is larger than the predetermined amount (ST25), the phases of the vaned wheels 114*i*, 114*j* are separately controlled (ST26).

This can prevent even the paper money P having a feeding dispersion deviating from the average or the paper money P having a skew from colliding against the vaned wheels 114*a* and 114*b*, 114*c* and 114*d*, 114*e* and 114*f*, 114*g* and 114*h*, or 114*i* and 114*j*.

Additionally, in the aforementioned example, the sensors S3*a*, S3*b* measure a skew amount, but the sensor for measure the skew amount may be disposed in the vicinity of the respective vaned wheels 114*e* and 114*f*, 114*g* and 114*h*, or 114*i* and 114*j*.

Moreover, the CPU has a multi-task structure, and performs a delivery feeding control of the paper money, simultaneously determines the control amount of the vaned wheel from calculation of the feeding dispersion and average reaching time, and gives an interrupt signal to the feeding control.

A third embodiment will next be described.

Also according to the first and second embodiments, the vaned wheels 114*a*, 114*b* are in a non-controlled state with respect to first several tens of sheets after start of processing. In this case, there is a fear that the paper money P collides against the tip end of the vaned wheels 114*a*, 114*b*. On the other hand, correction amounts (control amounts) of the vaned wheels 114*a*, 114*b*, . . . immediately before supply start of the paper money P (e.g., at an end of the previous operation) are stored in an internal memory 120*a* of the CPU 120 at the supply start. The correction amount can be used to synchronize the phase of the vaned wheels 114*a*, 114*b*, . . . before the supply start of the paper money P. Additionally, the control of the first embodiment may be performed.

As described above, according to the present embodiment, without mechanically synchronizing the taking-out device of the paper money and the rotation of the vaned wheel, for example, by a timing belt as conventional, the rotation phase of the vaned wheel can be controlled so that the tip end of the paper money does not easily collide against the tip end of the blade. Moreover, there is no problem that the mechanism becomes expensive and complicated by the mechanical synchronization. The dispersion of the pitch between the paper money by the actual taking-out and subsequent feeding can be handled.

That is, during the taking-out, the taking-out pitch fluctuates by a subtle friction force dispersion between the paper money. In the feeding by the belt, the pitch or the skew fluctuates by the change of the feeding speed by the change of the belt property by the temperature, or the irregular contact with the guide plate. However, the actual delivery feeding state is measured and fed back and the rotation phase of the vaned wheel is controlled.

Particularly, with respect to the skew of the paper money, two vaned wheels are driven by separate motors, and can therefore be set in separate phase angles. This can also solve a problem that the skewed paper money enters positions of separate phases.

Additionally, in the aforementioned embodiment, a case in which the present invention is applied to the classifying/sorting apparatus of sheets for classifying and sorting the paper money by the type has been described, but the present invention is not limited to this. The present invention can similarly be applied, for example, to the processing apparatus of the sheets, such as the classifying/sorting apparatus of the sheets which uses accumulation means of a vaned wheel system for classifying and sorting the sheets such as a check and gift certificate, and other securities by the type.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general invention concept as defined by the appended claims and their equivalents.

What is claimed is:

1. A processing apparatus of sheets, comprising:

a supply section configured to supply the sheets;

a feeding section configured to feed the sheets supplied by the supply section;

a vaned wheel which has a plurality of blades, and which rotates, thereby allowing said sheets to enter between said blades, and guides the sheets in a predetermined direction;

a accumulation section for accumulating the sheets guided by the vaned wheel;

a first detection section provided in the feeding section, for detecting the sheets fed by the feeding section;

a second detection section, disposed downstream of the first detection section at a predetermined interval from the first detection section, for detecting the sheets fed by said feeding section;

a first calculation section conflaured to calculate a sheet feeding speed of the feeding section based on detection results by the first and second detection sections and the distance between the first and second detection sections, and to calculate a time required for a sheet reaching the vaned wheel from the first detection section based on the sheet feeding speed and the distance between the vaned wheel and the first detection section;

a second calculation section configured to obtain a control amount of a rotation phase of said vaned wheel necessary to put a sheet between the blades of the vaned wheel from the time calculated by the first calculation section; and a control section configured to control the rotation phase of said vaned wheel in accordance with the control amount obtained by the second calculation section.

2. The apparatus according to claim 1, wherein said second calculation section acquires a tip-end passing time with respect to a plurality of sheets from the first calculation section, subjects the acquired tip-end passing time of the plurality of sheets to a predetermined calculation, and obtains the control amount of the rotation phase of said vaned wheel.

3. The apparatus according to claim 1, wherein an amount obtained before a supply operation of the sheets by said supply section is given as an initial value of said control amount.

4. The apparatus according to claim 1, wherein said control section has a reference signal as a time reference of the control, obtains a deviation amount from said reference signal when the sheets supplied by said supply section are fed by said feeding section and reach said vaned wheel, additionally obtains the deviation amount of rotation of said vaned wheel with respect to said reference signal, controls the rotation of said vaned wheel based on a difference of these obtained deviation amounts, and establishes synchronization between a supply timing of the sheets by said supply section and the rotation phase of said vaned wheel.

5. The apparatus according to claim 1, further comprising:

at least one other vaned wheel coaxially disposed with said vaned wheels wheel for guiding the sheets into said one accumulation section, and said second detection section includes at least two sensors, disposed at a predetermined interval in a direction crossing at right angles to the feeding direction in the middle portion of said feeding section, for detecting a tip end or a rear end of the sheets feed by said feeding section in a state in which synchronization is established between the rotation phase with respect to each vaned wheel and a supply timing of the sheets by said supply section.

6. A processing apparatus of sheets, comprising:

a supply section configured to supply the sheets;

a feeding section configured to feed the sheets supplied by the supply section;

a detection section configured to detect a type of the sheets from the sheets fed by the feeding section;

a sorting section configured to sort the sheets fed by said feeding section in accordance with a detection result of the detection section;

a plurality of vaned wheels which have a plurality of blades arranged at a predetermined interval in a rotation direction, and which rotate, thereby allowing the sheets sorted by said sorting section to enter between said blades, and guide the sheets in a predetermined direction;

a pluralty of accumulation sections for accumulating the sheets guided by the vaned wheels;

a first detection section provided in the feeding section, for detecting sheets fed by the feeding section;

a second detection section, disposed downstream of the first detection section at a predetermined interval from the first detection section, for detecting the sheets fed by said feeding section;

a first calculation section configured to calculate a sheet feeding speed of the feeding section based on detection results by the first and second detection sections and the distance between the first and second detection sections, and to calculate each time required for a sheet reaching each of the vaned wheels from the first detection section based on the sheet feeding speed and each distance between each of the vaned wheels and the first detection section;

a second calculation section configured to obtain a control amount of a rotation phase of each of said vaned wheels necessary to put a sheet between the blades of each of the vaned wheels from each time calculated by the first calculation section; and a control section configured to control the rotation phase of each of said vaned wheels in accordance with each control amount obtained by the second calculation section.

7. The apparatus according to claim 6, wherein said second calculation section acquires a tip-end passing time with respect to a plurality of sheets from the first calculation section, subjects the acquired tip-end passing time of the plurality of sheets to a predetermined calculation, and obtains the control amount of the rotation phase of said vaned wheel.

8. The apparatus according to claim 6, wherein an amount obtained before a supply operation of the sheets by said supply section is given as an initial value of said control amount.

9. The apparatus according to claim 6, wherein said control section has a reference signal as a time reference of the control, obtains a deviation amount from said reference signal when the sheets supplied by said supply section are fed by said feeding section and reach said vaned wheel, additionally obtains the deviation amount of rotation of said vaned wheel with respect to said reference signal, controls the rotation of said vaned wheel based on a difference of these obtained deviation amounts, and establishes synchronization between a supply timing of the sheets by said supply section and the rotation phase of said vaned wheel.

10. The apparatus according to claim 6, further comprising:

at least one other vaned wheel coaxially disposed with one of said vaned wheels for guiding the sheets into at least one of said accumulation sections, and said second detection section includes at least two sensors, disposed at a predetermined interval in a direction crossing at right angles to the feeding direction in the middle portion of said feeding section, for detecting a tip end or a rear end of the sheets fed by said feeding section in a state in which synchronization is established between the rotation phase with respect to each vaned wheel and a supply timing of the sheets by said supply section.

11. A processing apparatus of sheets, comprising:

a supply section configured to supply the sheets;

a feeding section configured to feed the sheets supplied by the supply section at a reference feeding speed;

a vaned wheel which has a plurality of blades, and which rotates, thereby allowing said sheets to enter between said blades, and guides the sheets in a predetermined direction;

an accumulation section for accumulating the sheets guided by the vaned wheel;

a first detection section provided in the feeding section, for detecting the sheets fed by the feeding section;

a second detection section, disposed downstream of the first detection section at a predetermined interval from the first detection section, for detecting the sheets fed by said feeding section;

a first calculation section configured to calculate a sheet feeding speed of the feeding section based on detection results by the first and second detection sections and the distance between the first and second detection sections, and to calculate a first time required for a sheet reaching the varied wheel from the first detection section based on the sheet feeding speed and the distance between the vaned wheel and the first detection section;

a second calculation section configured to calculate a second time based on the reference feeding speed and the distance between the varied wheel and first detection section;

a third calculation section configured to obtain a control amount of a rotation phase of said varied wheel necessary to put a sheet between the blades of the vaned wheel based on the first time calculated by the first calculation section and the second time calculated by the second calculation section; and a control section configured to control the rotation phase of said vaned wheel in accordance with the control amount obtained by the third calculation section.

12. A processing apparatus of sheets according to claim 11, further comprising:

a detection section configured to detect a type of the sheets from the sheets fed by the feeding section;

a sorting section configured to sort the sheets fed by said feeding section in accordance with a detection result of the detection section;

a plurality of vaned wheels which have a plurality of blades arranged at a predetermined interval in a rotation direction, and which rotate, thereby allowing the sheets sorted by said sorting section to enter between said blades, and guide the sheets in a predetermined direction; and a plurality of accumulation sections for accumulating the sheets guided by the vaned wheels.

* * * * *